United States Patent [19]

Hoshi et al.

[11] Patent Number: 4,850,533

[45] Date of Patent: Jul. 25, 1989

[54] TELESCOPIC DRINKING STRAW

[75] Inventors: Katsumasa Hoshi, Hasuda; Yukihiro Nomura, Oita; Ryosuke Kamei, Yokohama; Hiroshi Shibano, Yokohama; Takeshi Banba, Yokohama, all of Japan

[73] Assignee: Showa Denko Kabushiki Kaisha, Japan

[21] Appl. No.: 17,228

[22] PCT Filed: Jun. 20, 1986

[86] PCT No.: PCT/JP86/00315

§ 371 Date: Apr. 14, 1987

§ 102(e) Date: Apr. 14, 1987

[87] PCT Pub. No.: WO86/07529

PCT Pub. Date: Dec. 31, 1986

[30] Foreign Application Priority Data

Jun. 21, 1985 [JP] Japan ..... 60-93027
Aug. 1, 1985 [JP] Japan ..... 60-168547

[51] Int. Cl.[4] ..... A47G 21/18

[52] U.S. Cl. ..... 239/33; 285/260; 285/302

[58] Field of Search ..... 239/33, DIG. 19; 215/1 A; 220/90.2; 229/7 S, 103.1; 285/260, 302

[56] References Cited

U.S. PATENT DOCUMENTS

| | | | |
|---|---|---|---|
| 2,192,037 | 2/1940 | Hamilton | 239/33 |
| 2,392,479 | 1/1946 | Humbert | 239/33 |
| 3,346,187 | 10/1967 | Mueller | 239/33 |
| 3,971,578 | 7/1976 | Schemith | 285/260 |
| 4,152,017 | 5/1979 | Abramson | 285/260 |
| 4,657,182 | 4/1987 | Hoshi | 239/33 |
| 4,688,721 | 8/1987 | Inaba | 239/33 |

FOREIGN PATENT DOCUMENTS

| | | | |
|---|---|---|---|
| 172395 | 2/1986 | European Pat. Off. | 239/33 |
| 904010 | 8/1962 | United Kingdom | 239/33 |

*Primary Examiner*—Andres Kashnikow
*Assistant Examiner*—Michael J. Forman
*Attorney, Agent, or Firm*—Ostrolenk, Faber, Gerb & Soffen

[57] ABSTRACT

The present invention relates to a telescopic drinking straw or double sucking tube in which a synthetic resin tube section having a smaller diameter is inserted into a synthetic resin tube section having a larger diameter. In the sucking tube, a flange which is in tight contact with the inner surface of the larger tube section is formed on the smaller tube section, while a convex portion supporting the smaller tube section is formed on the inside of the larger tube section. Both the larger and smaller tube sections are produced from materials having different compositions from one another, so that leakage of fluid from a joint portion of the larger and smaller tube sections as well as shaky motion of the smaller tube section are prevented by these arrangements.

8 Claims, 1 Drawing Sheet

TELESCOPIC DRINKING STRAW

TECHNICAL FIELD

This invention relates to a telescopic sucking tube usually known as a drinking straw made of a synthetic resin which is used for drinking fruit juices, milk, refreshing drinks or the like.

BACKGROUND ART

Most conventional drinking straws have a single slender, tubular shape. Such a straw used for sucking drinking water or the like requires a fixed length for suction in view of the depth of the container which is used, while a straw as short as possible is desirable for the storage thereof, carriage, transportation and sale together with a container for beverage onto which such straw is attached.

Double telescopic sucking tubes or drinking straws have been known for solving the above problems. That type of drinking straw or sucking tube consists of a tube section having a larger diameter and another tube section having a smaller diameter which has been inserted into the inside of said larger diameter tube section (hereinafter referred to simply as "larger tube"). In case of sucking use as a drinking straw, the samller diameter tube section (hereinafter referred to simply as "smaller tube") may be drawn out from the larger tube to extend the length of the tube, while the smaller tube may be inserted deeply in the larger tube in the case where such telescopic sucking tube is not extended for suction.

Furthermore, it is desirble in such a double drinking straw or sucking tube that slip-preventing force acts between the smaller and larger tube in order that the smaller tube does not slip out or separate easily from larger tube in the case when the tube is extended for suction. It is also desirable that air not be aspirated from and liquid does not leak from the joint portion between the tubes when in use for suction. In this respect, both the tubes asre arranged in such manner that one end of the smaller tube which remains in the larger tube in the case when both the tubes are used together for sucking a drink is expanded to form a trumpet shape. A convex edge portion of the trumpet-shaped tube is in tight contact with the inner surface of the larger tube.

In the telescoped drinking draw or double sucking tube described above, the smaller tube has one end formed into an annular convex portion such as a trumpet-shaped or knot-like convex portion, and the convex portion is tightly contacted with the inner surface of the larger tube. In the above construction, however, no other portion of the smaller tube comes in tight contact with the inner surface of the larger tube, so that the smaller tube is unstable with respect to the larger tube. As a result, a stable sliding operation as well as a tightly contacting state established between said larger and smaller tubes cannot be maintained.

DISCLOSURE OF THE INVENTION

An object of the present invention is to provide a telescopic drinking straw or sucking tube having a novel construction by which the problem arising from undesired air suction and liquid leakage due to shaking of the smaller tube can be solved through a mutually related construction between the larger tube and the smaller tube.

A further object of the present invention is to provide a telescopic drinking straw or sucking tube having a novel construction by which said problem can be solved by suitably selecting synthetic resin materials for producing the larger and smaller tubes. The object is to have a structure in which there is no shaking of the smaller tube in the larger tube.

In a telescopic drinking straw or sucking tube consisting of a larger diameter tube section and a smaller diameter tube section inserted in the hollow portion of said larger tube, the structure of the present invention comprises a flanged formed on one end of the smaller tube so as to be in tight contact with the inner surface of said larger tube, and an additional convex portion or guide formed on the inside of said larger tube in the vicinity of the end portion from which said smaller tube is drawn out in such a manner that said convex portion is always in contact with the outer surface of said smaller tube to support the same.

In addition to said construction, the telescopic drinking straw or sucking tube according to the present invention (consisting of a larger diameter tube section and a smaller diameter tube section wherein said smaller tube is inserted into said larger tube in such a way that an expanded end or convex portion of said smaller tube is in tight contact with the inner surface of said larger tube), is constructed so that said larger tube is produced from a resin composition consisting of 5–30% by weight of ethylene propylene elastomer and 70–95% by weight of ethylene propylene block copolymer and having a melt flow index of 5–15 g/10 min, and said smaller tube is produced from a resin composition of propylene homopolymer having a melt flow index of 7–14 g/10 min.

BRIEF DESCRIPTION OF THE DRAWING

The drawings show examples of the telescopic drinking straw or sucking tube according to the present invention in which.

BEST MODE FOR EMBODYING THE INVENTION

Figure 1:
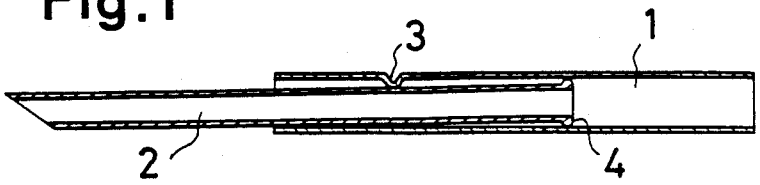
FIGS. 1 and 2 are sectional views each showing a telescopic drinking straw or sucking tube wherein a smaller tube is stabilized and supported at at least two areas of the interior of the larger tube by means of both larger and smaller tubes.

In FIG. 1, a tube section 1 of a larger diameter (larger tube) has a convex portion 3 protruding inwardly therein in the vicinity of its end portion on the side where an end portion of a tube section 2 having a smaller diameter (smaller tube) remains in said larger tube when the telescopic drinking straw is extended for use. The smaller tube 2 has an outwardly protruding flange 4 in the vicinity of an end portion thereof on the side where the end portion remains in said larger tube when the straw is extended for use. The smaller tube 2 is inserted telescopically into the larger tube 1 in such a manner that the flange 4 is in tight contact with the inner surface of said larger tube 1. Thus, there is neither air suction nor liquid leakage past the joint portion of both the tubes, because of the provision of the flange 4.

It is preferred to dispose the flange 4 in the vicinity of an extreme end portion of the smaller tube 2 as shown in FIG. 1 in order that the whole length of the telescopic drinking straw or sucking tube may be extended as long as possible.

In the telescopic drinking straw or sucking tube according to the present example, since the convex portion 3 is also formed on the inner surface of the larger tube 1, the flange 4 of the smaller tube 2 abuts against said convex portion 3 so that the smaller tube 2 cannot be extended any more and said smaller tube 2 does not pull out from said larger tube 1. In this case, the convex portion 3 of said larger tube 1 serves also as a stopper. Furthermore, even if there is some spacing due to a difference between the diameters of the larger tube 1 and the smaller tube 2, no shaking of the smaller tube 2 occurs because of the convex portion 3. As a result, a stable tightly contacting state of said flange 4 can be maintained on the inner surface of the larger tube 1, and a stable sliding operation of both the tubes can be attained.

In the present example, one convex portion 3 may be provided on the inner surface of the larger tube 1, but more stable sliding becomes possible in the case when either a plurality of convex portions are provided along the circumferential direction of the larger tube 1 or said convex portion 3 is formed into an annular convex portion.

Figure 2:
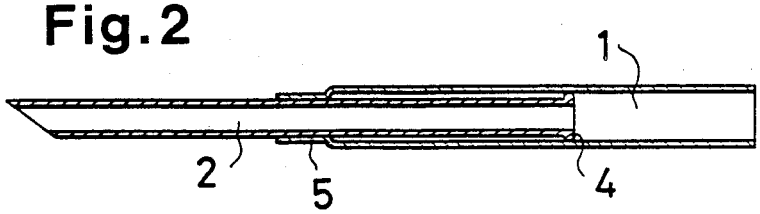

FIG. 2 shows another example of the telescopic drinking straw in which a diameter of an extreme end portion 5 of the larger tube 1 is made smaller than the other portion. In accordance with such modification, the smaller extreme end portion 5 of the larger tube 1 functions as a stopper which prevents the smaller tube 2 from slipping out of the lrger tube. Also, shaking of the smaller tube 2 is eliminated to make stable sliding possible.

The convex portion 3 shown in FIG. 1 can easily be shaped by pushing a heated knife edge against a required portion of the larger tube 1, and the diameter of the extreme end portion 5 of FIG. 2 can also easily be reduced by using dies.

Figure 3:
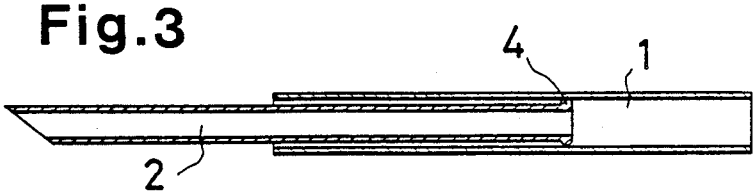
FIGS. 3 and 4 are sectional views each showing a a telescopic drinking straw or sucking tube wherein the composition of the larger tube material differs from that of the smaller material.
Figure 4:
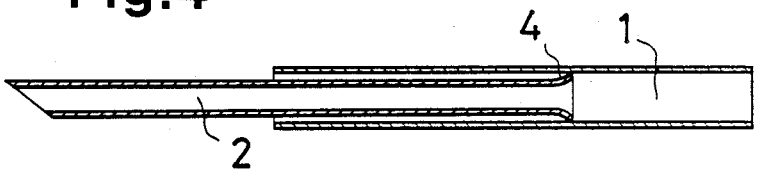

FIGS. 3 and 4 each illustrate a telescopic drinking straw or sucking tube wherein a flange 4 is merely formed on the inner end portion of a smaller tube 2 which is the side to be inserted into a larger tube 1, but the larger tube 1 is produced from synthetic resin material than that from which the smaller tube 2 is produced. Air suction and liquid leakage due to appearance of spacings are thereby prevented. In these examples the larger tube 1 is produced from a resin composition having a melt flow index of 5–15 g/10 min (JIS K 6758) and consisting of 5–30% by weight of ethylene propylene elastomer and 70–95% by weight of ethylene propylene block copolymer, while the smaller tube 2 is produced from a resin composition of propylene homopolymer having a melt flow index of 7–14 g/10 min.

Concerning the larger tube 1 and the smaller tube 2 (of FIGS. 3 and 4) produced from the resin compositions as described above, even if the inner diameter of the larger tube 1 is formed slightly smaller, e.g. by about 1 mm–1/10 mm than the outer diameter of the flange 4 on the smaller tube 2, the inner end portion of the smaller tube 2 can easily be inserted into the larger tube 1, whereby a double telescopic sucking tube or straw is obtained.

When the resin composition as described aboe is selected as a material for the larger tube 1 of FIGS. 3 and 4 so that a sufficiently elastic, but tough larger tube is produced, it becomes also possible to insert the flange 4 on the inner end portion of the smaller tube 2 which has a slightly larger diameter than the inner diameter of the larger tube 1 into such larger tube as mentioned above. As a result of that the smaller tube 2 is produced from a propylene homopolymer, elasticity of the flange portion becomes moderate, so that when it is combined with the larger tube 1 produced from said material, the tightness between the inner surface of said larger tube and the inner end portion of the smaller tube 2 becomes complete.

The reason why the melt flow index of the resin composition which is used for producing the larger tube has a range of 5–15 g/10 min is due to its moldability as well as to cause tightness between the larger and smaller tubes. When the melt flow index of said resin composition is less than 5 g/10 min, its productivity decreases, besides tightness between the larger and smaller tubes is reduced. On the other hand, dimensional accuracy of the larger tube 1 becomes worse, if it is produced from a resin composition having a melt flow index of more than 15 g/10 min, and slidability between both the larger and smaller tubes becomes also worse in this case. Hence, in both cases a melt flow index of the resin composition for the larger tube 1 outside of said range is undesirable.

An ethylene propylene elastomer in said resin composition for the larger tube 1 is a copolymer prepared from ethylene and propylene as the major components thereof, or a copolymer prepared from components of diolefins, cyclic diene hydrocarbons and the like in addition to ethylene and propylene, and in this case, preferably, an elastomer containing 20–80% by weight of ethylene, because the resulting elastomer is more elastic.

As to said resin composition, in the case where a concentration of ethylene in the ethylene propylene block copolymer is less than 10% by weight, elasticity of the block copolymer tends to be deficient. On the other hand, more than 40% by weight of ethylene is not desirable, because too much elasticity is observed.

Furthermore, in the case where an ethylene propylene elastomer is less than 5% by weight in said resin composition, its elasticity becomes deficient, while if the ethylene propylene elastomer is more than 30% by weight, its post-molding stability decreases so that the dimensional accuracy is adversely affected.

On one hand, since a propylene homopolymer from which the smaller tube 2 is produced has toughness to some extent, the flange 4 thereof is in tight contact with the inner surface of the larger tube 1, but if a melt flow index of the homopolymer is less than 7 g/10 min, its productivity decreases also; and tightness of the resulting homopolymer with respect to the larger tube becomes inferior. On the other hand, the smaller tube produced from a propylene homopolymer having a melt flow index of more than 14 g/10 min becomes worse in dimensional accuracy, and slidability between the larger and smaller tubes becomes also worse. Thus, both the above former and latter cases where a melt flow index of the propylene homopolymer for the smaller tube 2 is out of said range are undesirable.

In the case where high-density polyethylene is used for a material of both the larger and smaller tubes, the resulting tubes are deficient in toughness, dimensional accuracy, and circularity, while if both the tubes are produced from low-density polyethylene, the toughness becomes more deficient and besides the dimensional accuracy and circularity are also deficient.

Figure 5:
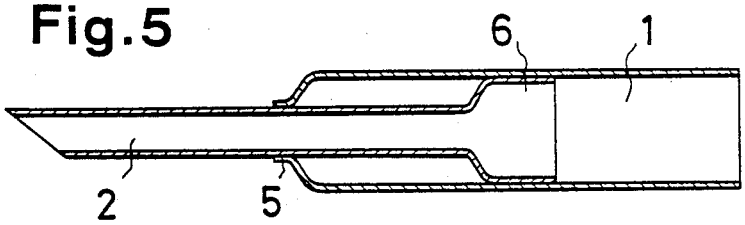
FIG. 5 is a sectional view showing a telescopic drinking straw or sucking tube wherein a smaller tube is stabilized by means of the conformation of the larger and smaller tube tubes as well as the respective compositions the larger and smaller tube materials.

FIG. 5 illustrates another example in which both larger and smaller tubes of a telescopic drinking straw or sucking tube having a similar construction to that shown in FIG. 2 are produced from the above-mentioned resin compositions. Accordingly, an extreme end portion 5 of the larger tube 1 is reduced so that the diameter thereof is smaller than that of the other part of the larger tube 1, while an inner end portion 6 of the smaller tube 2 to be inserted into the larger tube 1 is cylindrically expanded so that a diameter of the inner end portion 6 is larger than that of the other part of the smaller tube 2. Hence, when the smaller tube 2 is drawn out from the larger tube 1, they are locked by the reduced portion of said larger tube 1 and the inner end portion 6 of said smaller tube 2. Furthermore, in this situation, it is preferred to form the extreme end portion 5 and the inner end portion 6 in such manner that they are substantially in perfect contact with each other in the place where a configuration of a truncated cone is defined by both the portions.

Moreover, it is preferred to arrange the inner surface of the cylindrical extreme end portion 5 of the larger tube 1 so as to closely fit to the outer surface of the portion of smaller tube 2 having a smaller diameter when the smaller tube 2 is pushed in the larger tube 1, while the outer surface of the cylindrical inner end portion 6 of said smaller tube 2 is arranged so as to closely fit to the inner surface of the portion having a larger diameter than that of the extreme end portion 5 in said larger tube 1. thus, stable movements between the larger and smaller tubes become possible, and tight contact between them at the time of suction can attain in a substantially perfect state in case of the operations where the smaller tube 2 is pulled out from and pushed in the larger tube 1.

In the sucking tube of FIG. 5 as described above, if the larger and smaller tubes 1 and 2 are produced from the above-mentioned resin compositions, respectively, the telescopic drinking straw or sucking tube has better airtightness and better stability of the smaller tube.

As described above, in the telescopic drinking straw or sucking tube according to the present invention, airtightness of the joint as well as stability for the smaller tube can be obtained on the basis of a interrelated construction between the larger and smaller tubes as well as the selection for the resin compositions from which both the tubes are produced. In addition, the construction of the present telescopic drinking straw or sucking tube is simple and no part detracts from mass production. Therefore, the telescopic drinking straw or sucking tube of the present invention is widely applicable for straw for drinks and the like purposes.

We claim:

1. A telescopic drinking straw comprising a larger diameter tube section made of a first synthetic resin and a smaller diameter tube section made of a second synthetic resin which is different than said first synthetic resin; each said tube section having an outer surface and a hollow portion defined by an inner surface; said smaller diameter tube section being inserted in said hollow portion of said larger diameter tube section; an end portion of said smaller diameter tube section having a flange thereon which is left inside said larger diameter tube section when said smaller diameter tube section is extended for suction; said larger diameter tube section being formed from a resin composition consisting of 5–30% by weight of ethylene propylene elastomer and 70–95% by weight of ethylene propylene block copolymer and having a melt flow index of 5–15 g/10 min, and said smaller diameter tube section being formed from a propylene homopolymer having a melt flow index of 7–14 g/10 min; said different synthetic resins being selected so as to facilitate the efficient production of said telescopic drinking straw without the creation of an undesirable spacing between said inner surface of said larger diameter tube section and said end portion of said smaller diameter tube section.

2. A telescopic drinking straw as claimed in claim 1, wherein said flange of said smaller diameter tube section comprises an expanded portion at the end thereof extending into said larger diameter tube section.

3. A telescopic drinking straw as claimed in claim 1, wherein said flange of said end portion of said smaller diameter tube section is cylindrically expanded.

4. A telescopic drinking straw comprising a larger diameter tube section made of a first synthetic resin and a smaller diameter tube section made of a second synthetic resin which is different than said first synthetic resin; each said tube section having an outer surface and a hollow portion defined by an inner surface; said smaller diameter tube section being inserted in said hollow portion of said larger diameter tube section; a flange formed on said smaller diameter tube section, said flange being in close sealing contact with said inner surface of said larger diameter tube section, said larger diameter tube section having an inwardly projecting convex portion which is always in contact with said outer surface of said smaller diameter tube section to support said smaller diameter tube section at said inner surface of said larger diameter tube section; said larger diameter tube section being formed from a resin composition consisting of 5–30% by weight of ethylene propylene elastomer and 70–95% by weight of ethylene propylene block copolymer and having a melt flow index of 5–15 g/10 min, and said smaller diameter tube section being formed from a propylene homopolymer having a melt flow index of 7–14 g/10 min; said different synthetic resins being selected so as to facilitate the efficient production of said telescopic drinking straw with said close sealing contact between said flange and said inner surface of said larger diameter tube section.

5. A telescopic drinking straw as claimed in claim 4, wherein said convex portion of said lrger diameter tube section comprises a deformed inwardly indented portion thereof.

6. A telescopic drinking straw as claimed in claim 4, wherein said convex portion of said larger diameter tube section is formed by reducing the diameter of an extreme end portion of said larger diameter tube section.

7. A telescopic drinking straw as claimed in claim 4, wherein said flange of said smaller diameter tube section comprises an expanded portion at the end thereof extending into said larger diameter tube section.

8. A telescopic drinking straw as claimed in claim 4, wherein said flange of said smaller diameter tube section is cylindrically expanded.

* * * * *